US006651407B2

(12) United States Patent
Hiramoto et al.

(10) Patent No.: US 6,651,407 B2
(45) Date of Patent: Nov. 25, 2003

(54) BAG SUPPLYING DEVICE FOR AN AUTOMATED PACKAGING MACHINE

(75) Inventors: Shinichi Hiramoto, Iwakuni (JP); Sumio Fukuda, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 4 days.

(21) Appl. No.: 10/007,946

(22) Filed: Dec. 5, 2001

(65) Prior Publication Data

US 2002/0066260 A1 Jun. 6, 2002

(30) Foreign Application Priority Data

Dec. 6, 2000 (JP) ..... 2000-370870

(51) Int. Cl.[7] ..... B65B 43/26
(52) U.S. Cl. ..... 53/570; 53/571; 53/386.1
(58) Field of Search ..... 53/571, 570, 573, 53/386.1, 384.1

(56) References Cited

U.S. PATENT DOCUMENTS

| | | | | |
|---|---|---|---|---|
| 2,700,496 A | | 1/1955 | Dickey et al. | |
| 3,673,759 A | | 7/1972 | Ayres et al. | |
| 3,953,020 A | * | 4/1976 | Ruf et al. | 271/14 |
| 3,986,322 A | * | 10/1976 | Taylor | 53/571 |
| 4,411,296 A | * | 10/1983 | Durant | 141/98 |
| 5,463,845 A | * | 11/1995 | Gwiazdon et al. | 53/459 |
| 5,507,132 A | * | 4/1996 | Gwiazdon et al. | 53/469 |

FOREIGN PATENT DOCUMENTS

| | | |
|---|---|---|
| DE | 3639484 | 5/1988 |
| JP | 60-183324 | 9/1985 |
| JP | H6-55604 | 7/1994 |
| JP | H6-55605 | 7/1994 |
| JP | H7-5125 | 1/1995 |

* cited by examiner

*Primary Examiner*—Eugene Kim
(74) *Attorney, Agent, or Firm*—Koda & Androlia

(57) ABSTRACT

A bag supplying device including a conveying arm that has a fixed clamping element and a movable clamping element, a reciprocating-rotating assembly that causes the conveying arm to make a back-and-forth rotational movement between a downwardly-facing clamping position and a substantially horizontal intermediate position, a slide frame on which the rotational shaft is rotatably supported, a reciprocating movement assembly that reciprocates the slide frame horizontally so that the conveying arm advances toward and retracts from a transfer position (where bags are transferred) to a gripper, and an opening-and-closing assembly that opens and closes the movable clamping element. With the bag mouth of an empty bag clamped by the clamping element, the conveying arm rotates upward and then advances to the transfer position, then the movable clamping element opens so as to transfer the empty bag, which is in a vertical attitude, to the gripper.

4 Claims, 9 Drawing Sheets

BAG SUPPLYING DEVICE FOR AN AUTOMATED PACKAGING MACHINE

BACKGROUND OF THE INVENTION

1. Field of the Invention

The present invention relates to a bag supplying device that supplies packaging bags to an automated packaging machine.

2. Prior Art

Japanese Patent Application Publication (Kokoku) No. H07-5125 discloses a device that supplies packaging bags to an automated packaging machine.

In this bag supplying device, the bag surface of an uppermost empty bag of empty bags stacked horizontally in a bag storage receptacle is suction-chucked and lifted by a vacuum suction lifting device. The bag mouth of this empty bag is then gripped by a pair of bag gripping means provided near the tip end of a gripping portion main body (and transferred to the gripping means from the vacuum suction lifting device). The bag is next conveyed obliquely upward in a substantially rectilinear manner while being gradually changed to a vertical attitude. The bag is then moved more or less horizontally in this attitude and is placed in the position of the gripper of a packaging machine. The gripper is next closed and grips the empty bag, and then the gripping means are opened.

Japanese Patent Application Publication (Kokoku) No. 6-55604 also discloses a bag supplying device.

In this bag supplying device, the bag surface of the uppermost empty bag of empty bags stacked horizontally in a case is suction-chucked and lifted by the first suction chucking plate and suction plate that are provided at the tip end of a first swinging suction-chucking arm. The bag surface near the bag mouth is suction-chucked by the second suction chucking plate and suction plate that are provided at the tip end of a second swinging suction-chucking arm (that is, the bag is transferred from the fist suction chucking plate and suction plate to the second suction chucking plate and suction plate). Then, the bag is conveyed upward along a circular-arc-form track. The bag that takes a vertical attitude at the top is clamped at its mouth by a pair of clamping elements (that is, the bag is transferred from the second suction chucking plate and suction plate to a pair of clamping elements). The pair of clamping elements are then moved horizontally so that the empty bag is placed in the position of the gripper of a packaging machine. The gripper is closed and grips the empty bag, after which the pair of clamping elements 42 and 43 are opened.

In recent years, due to the problems of conservation of resources and waste treatment, etc., packaging bags with a small thickness have begun to be used. Furthermore, there has been a demand for an increased speed in the bag supplying process (i.e., an increase in the number of bags supplied per unit time) in order to increase the operation speed of the packaging machine.

However, in the device described in Japanese Patent Application Publication (Kokoku) No. H07-5125, the bags are shifted from a substantially horizontal attitude to a substantially vertical attitude during the rectilinear transfer to the gripper; as a result, the bags are easily affected by air resistance. Furthermore, as the thickness of the bags is reduced, the strength of the bags becomes weaker; and as the speed of the bag supply operation is increased, the bags are affected by a greater air resistance. As a result, problems arise. The bag surfaces would be warped by air resistance during transfer, so that the vertical attitude of the bags is lost, resulting in that the gripper cannot receive the bags in a stable fashion. Furthermore, in the above bag supplying device, the opening and closing of the gripping means that grips the bags is accomplished by an air cylinder; accordingly, the response characteristics are poor. Thus, this bag supplying device is not suitable for high-speed operation.

In the bag supplying device described in Japanese Patent Application Publication (Kokoku) No. H06-55605, the bags are rotated and conveyed via a circular-arc-form path that is oriented more or less along the bag surfaces and then take a vertical attitude. Subsequently, the bags in a vertical attitude are horizontally transferred over a short distance. Thus, this device is advantageous in that the bag surfaces are relatively less affected by air resistance. However, the bags are transferred twice during the conveying process. Accordingly, there is a greater possibility of transfer errors. Moreover, the time loss caused by the two-time transfer can easily increases, and it is difficult to achieve high-speed bag supply. In addition, since rotating-conveyance is performed by way of vacuum-chucking only one surface of each bag, there is a possibility that the bag mouth would open during the conveying process, especially when the speed is high. Thus, errors can easily occur in the transfer of the bags to the pair of clamping elements.

SUMMARY OF THE INVENTION

Accordingly, the present invention is to solve the problems with the conventional bag supplying devices.

It is thus an object of the present invention to provide a bag supplying device that eliminates transfer errors during the conveyance of bags.

It is another object of the present invention to provide a bag supplying device that supplies bags in a vertical attitude to a gripper, etc. of an automated packaging machine without causing any transfer errors of bags to the gripper, etc.

It is still another object of the present invention to provide a bag supplying device that can meet the decrease in the thickness of bags and the increase in the speed of bag supply.

The above objects are accomplished by a unique structure for a bag supplying device that is used in an automated packaging machine, and the bag supplying device comprises:

- a conveying arm having a pair of clamping elements in the vicinity of a tip end thereof, the clamping elements for clamping bag mouths of empty bags,
- a back-and-forth rotation means that causes the conveying arm to make a back-and-forth rotational movement about an axis of a horizontal rotational shaft, the back-and-forth rotational movement being made together with the rotational shaft so that the conveying arm rotates between a downwardly-oriented clamping position and a substantially horizontal intermediate position,
- a reciprocating movement means that causes the conveying arm to advance and retract horizontally between the intermediate position and a transfer position, and
- an opening-and-closing means that opens and closes the pair of clamping elements, wherein
  - when the conveying arm is in the clamping position, the clamping elements close and clamp a bag mouth of an empty bag,
  - the empty bag takes a substantially vertical attitude as the conveying arm rotates upward and approaches the intermediate position, and the clamping elements open when the conveying arm advances and reaches the transfer position, so that the empty bag that is in a substantially vertical attitude is transferred to a next holding means.

The above objects are accomplished by another unique structure for a bag supplying device used in an automated packaging machine, and the bag supplying device comprises:

a conveying arm having a pair of clamping elements in the vicinity of a tip end thereof, the clamping elements for clamping bag mouths of empty bags, a back-and-forth rotation means that causes the conveying arm to make a back-and-forth rotational movement about an axis of a horizontal rotational shaft, the back-and-forth rotational movement being made together with the rotational shaft so that the conveying arm rotates between a downwardly-oriented clamping position and a substantially horizontal intermediate position, a slide frame that rotatably supports the rotational shaft, a reciprocating movement means that causes the slide frame to make a reciprocating movement in a horizontal direction, thus causing the conveying arm to advance toward and retract from a transfer position, and an opening-and-closing means that opens and closes the pair of clamping elements, wherein when the conveying arm is in the clamping position, the clamping elements close and clamp a bag mouth of an empty bag, the empty bag takes a substantially vertical attitude as the conveying arm rotates upward and approaches the intermediate position, and the clamping elements open when the conveying arm advances and reaches the transfer position, so that the empty bag that is in a substantially vertical attitude is transferred to a next holding means.

Needless to say, when the slide frame makes the reciprocating movement, the conveying arm makes a reciprocating movement accordingly.

In the above bag supplying device: the opening-and-closing means that opens and closes the clamping elements is provided with a mechanical cam and a transmission mechanism. The mechanical cam is disposed outside the slide frame, and the transmission mechanism transmits a driving force from the mechanical cam to the clamping elements. The transmission mechanism comprises a first transmission rod and a second transmission rod, the first transmission rod being disposed along the horizontal rotational shaft and making a reciprocating movement together with the horizontal rotational shaft, and the second transmission rod being disposed along the conveying arm and rotates together with the conveying arm. The driving force of the mechanical cam is transmitted to the clamping elements via the first and second transmission rods.

Furthermore, between the mechanical cam and the first transmission rod, between the first transmission rod and the second transmission rod, and between the second transmission rod and the clamping elements, transmission mechanisms such as link mechanisms, levers, rods, etc., which transmit the driving force, are respectively interposed. In this case, the driving force of the mechanical cam opens and closes the clamping elements via a mechanical transmission mechanism. Thus, the response characteristics are improved compared the conventional air cylinder driving.

In the above structure, it is preferable that the horizontal rotational shaft has a hollow tubular form, and the first transmission rod is disposed in coaxial with and inside the hollow horizontal rotational shaft. Because of this structure, the position of the first transmission rod relative to the horizontal rotational shaft does not change even when the horizontal rotational shaft rotates. Thus, the driving force transmission mechanisms (between the mechanical cam and the first transmission rod, and between the first transmission rod and the second transmission rod) can be simplified. By way of causing the first transmission rod to advance and retract in, for instance, the axial direction or to rotate about its axis, the driving force from the mechanical cam is transmitted to the second transmission rod.

Furthermore, the above objects are accomplished by still another unique structure for a bag supplying device that is used in an automated packaging machine, in which the bag supplying device uses a vacuum suction holder instead of the pair of clamping elements. More specifically the bag supplying device having still another unique structure comprises:

a conveying arm having a vacuum suction holder in the vicinity of a tip end thereof, the vacuum suction holder for suction-chucking empty bags, a back-and-forth rotation means that causes the conveying arm to make a back-and-forth rotational movement about an axis of a horizontal rotational shaft together with the horizontal rotational shaft so that the conveying arm rotates between a downwardly-oriented suction-chucking position and a substantially horizontal intermediate position, and a reciprocating movement means that causes the conveying arm to advance and retract horizontally between the intermediate position and a transfer position, wherein when the conveying arm is in the suction-chucking position, the vacuum suction holder suction-chucks an empty bag, the empty bag takes a substantially vertical attitude as the conveying arm rotates upward and approaches the intermediate position, and the vacuum suction holder stops suction-chucking when the conveying arm advances and reaches the transfer position, so that the empty bag that is in a substantially vertical attitude is transferred to a next holding means.

In addition, the above objects are accomplished by still a further unique structure for a bag supplying device that is used in an automated packaging machine, in which the bag supplying device uses a vacuum suction holder instead of the pair of clamping elements. More specifically the bag supplying device that has a further unique structure comprises:

a conveying arm having a vacuum suction holder in the vicinity of a tip end thereof, the vacuum suction holder for suction-chucking empty bags, a back-and-forth rotation means that causes the conveying arm to make a back-and-forth rotational movement about an axis of a horizontal rotational shaft together with the horizontal rotational shaft so that the conveying arm rotates between a downwardly-oriented suction-chucking position and a substantially horizontal intermediate position, and a slide frame that rotatably supports the horizontal rotational shaft, and a reciprocating movement means that causes the slide frame to make a reciprocating movement in a horizontal direction, thus causing the conveying arm to advance toward and retract from a transfer position, wherein when the conveying arm is in the suction-chucking position, the vacuum suction holder suction-chucks an empty bag, the empty bag takes a substantially vertical attitude as the conveying arm rotates upward and approaches the intermediate position, and the vacuum suction holder stops suction-chucking when the conveying arm advances and reaches the transfer position, so that the empty bag that is in a substantially vertical attitude is transferred to a next holding means.

Each of the above-described transfer devices of the present invention transfers empty bags to, for example, the gripper of an automated packaging machine. However, as long as the element that hold empty bags holds the bags in a substantially vertical attitude, then such an element is not limited to a gripper.

DETAILED DESCRIPTION OF THE INVENTION

The bag supplying device of the present invention will be described below with reference to FIGS. 1 through 7.

Like the devices disclosed in the above-described Japanese Patent Application Publication (Kokoku) Nos. H07-5125 and H06-55604, the bag supplying device of the present invention grips the bag mouth of an empty bag and supplies the bag to an automated packaging machine. In other words, the bag supplying device grips the bag mouth of an empty bag that is the uppermost one of the empty bags stacked horizontally in a bag storage receptacle. The bag supplying device grips the empty bag that has been lifted by a vacuum suction holder and supplies this bag in substantially a vertical attitude to the gripper of an automated packaging machine.

Figure 1:
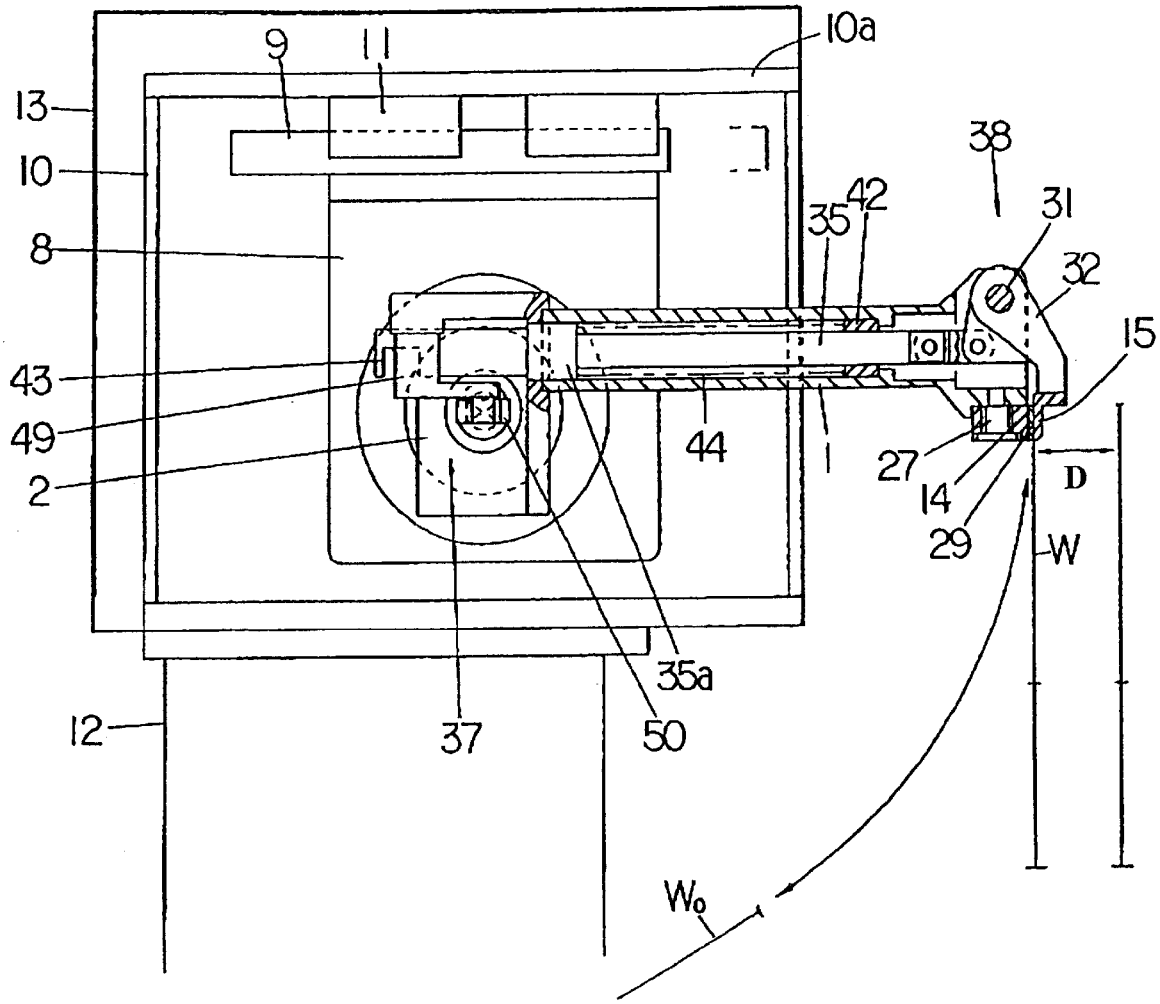
FIG. 1 is a left-side view, in cross section, of the bag supplying device according to the present invention.
Figure 2:
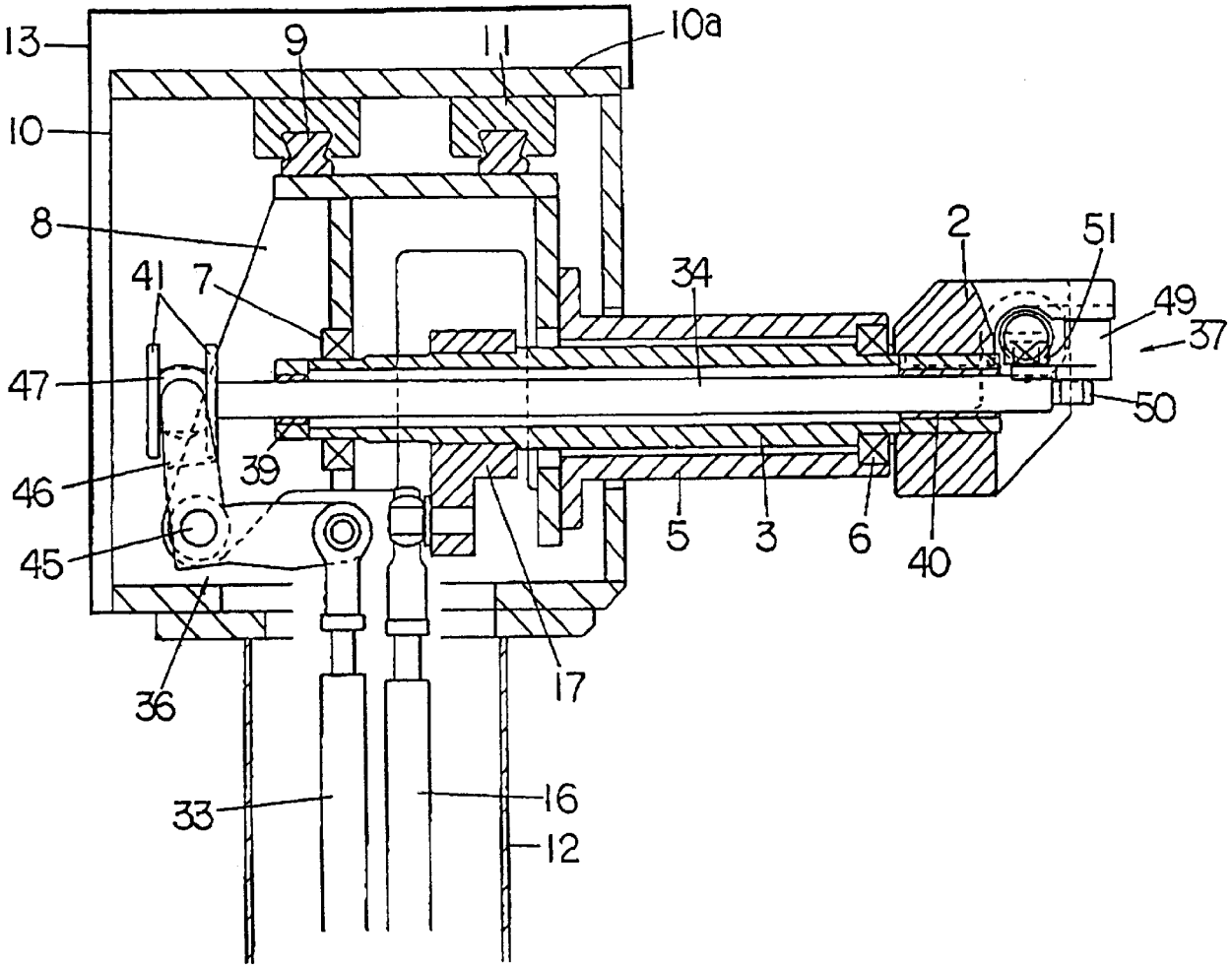
FIG. 2 is a rear view thereof in cross section.

As shown most clearly in FIGS. 1 and 2, the rear end of a conveying arm 1 is fastened to a rotating block 2, and this rotating block 2 is fastened to the tip end of a hollow rotational shaft 3 that is disposed horizontally. The hollow rotational shaft 3 is provided in a slide frame 8 via a supporting holder 5 and bearings 6 and 7 so that the hollow rotational shaft 3 is free to rotate. Slide rails 9 are fastened to the slide frame 8 and fitted in rail guides 11 that are disposed on the top plate 10*a* of a box 10. The horizontal movement of the slide frame 8 is guided by the rail guides 11. The box 10 is disposed on top of a hollow stand 12 and accommodates the major portion of the operating mechanism of the bag supplying device. The periphery of this box 10 is surrounded by a box cover 13.

A pair of clamping elements 14 and 15 that hold the bag mouths of empty bags are disposed in the vicinity of the tip end of the conveying arm 1. The conveying arm 1 is caused to make a back-and-forth rotational movement about the axial center of the hollow rotational shaft 3 by a back-and-forth rotation means (described later). This back-and-forth rotational movement is made between a substantially downwardly-oriented clamping position and a substantially horizontal intermediate position (the position shown in FIG. 1). The clamping position is the position where the bag mouth of an empty bag W (indicated in particular as $W_0$ in FIG. 1) lifted from the bag storage receptacle is clamped by the clamping elements 14 and 15.

Figure 3:
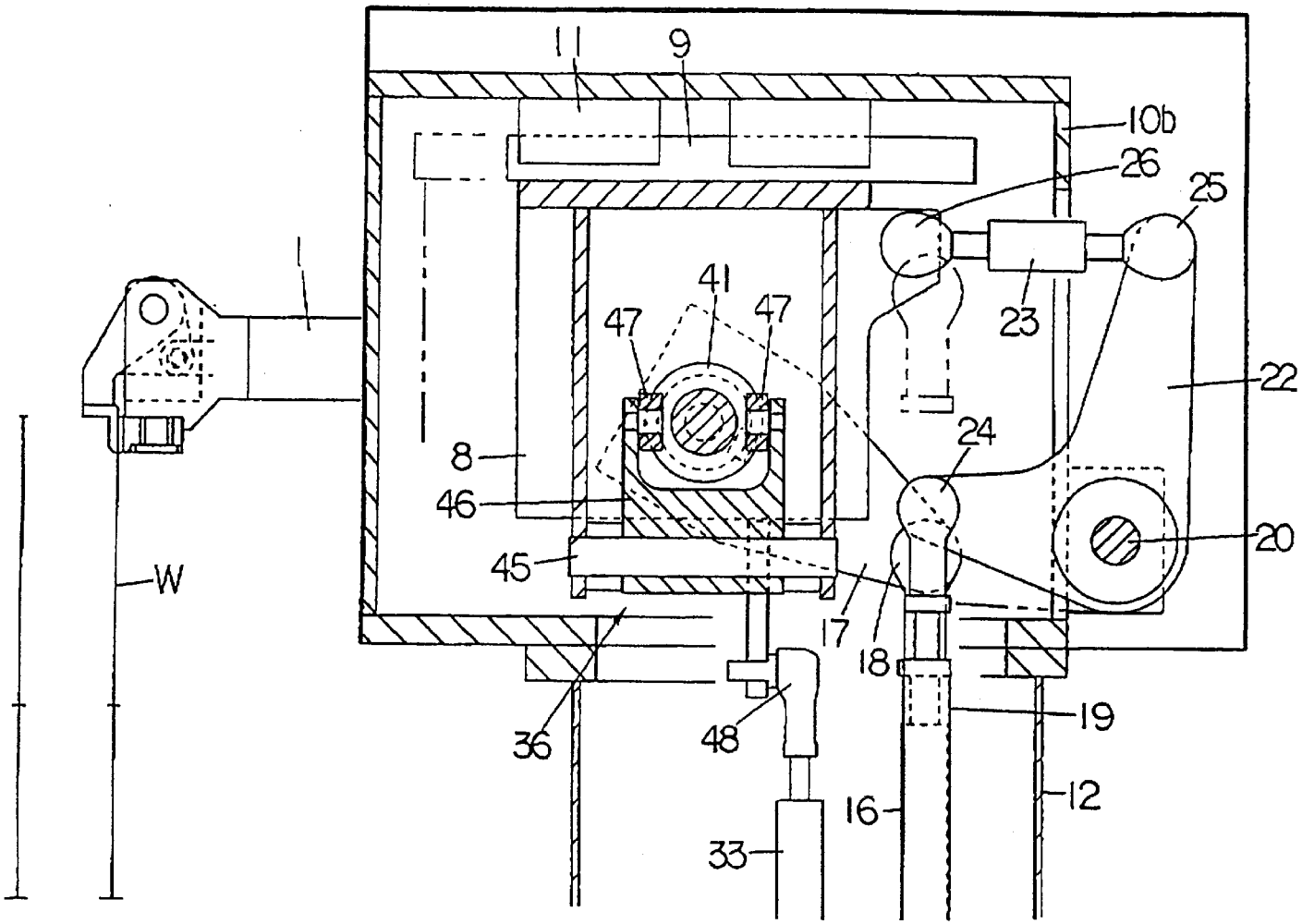
FIG. 3 is a right-side view thereof in cross section.

As seen from FIGS. 2 and 3, the back-and-forth rotation means is comprised of a conveying arm rotating rod 16, which is linked to a mechanical cam (not shown), and a rotating lever 17, which is attached to the hollow rotational shaft 3. The upper end of the conveying arm rotating rod 16 and the end portion of the rotating lever 17 are connected via a universal joint 18. The conveying arm rotating rod 16 is raised and lowered (see the solid line and imaginary dotted line in FIG. 3) by the driving force of the mechanical cam, the hollow rotational shaft 3 thus rotates. As a result, the conveying arm 1 makes a back-and-forth rotational movement as described above. A universal joint is also connected to the lower end of the conveying arm rotating rod 16, so that the conveying arm rotating rod 16 can tilt within the plane that is parallel to the direction of movement of the slide frame 8.

The conveying arm 1 is caused to also make a horizontal reciprocating movement upon the horizontal reciprocating movement of the slide frame 8 that is made by a reciprocating movement means (described later).

Figure 4:
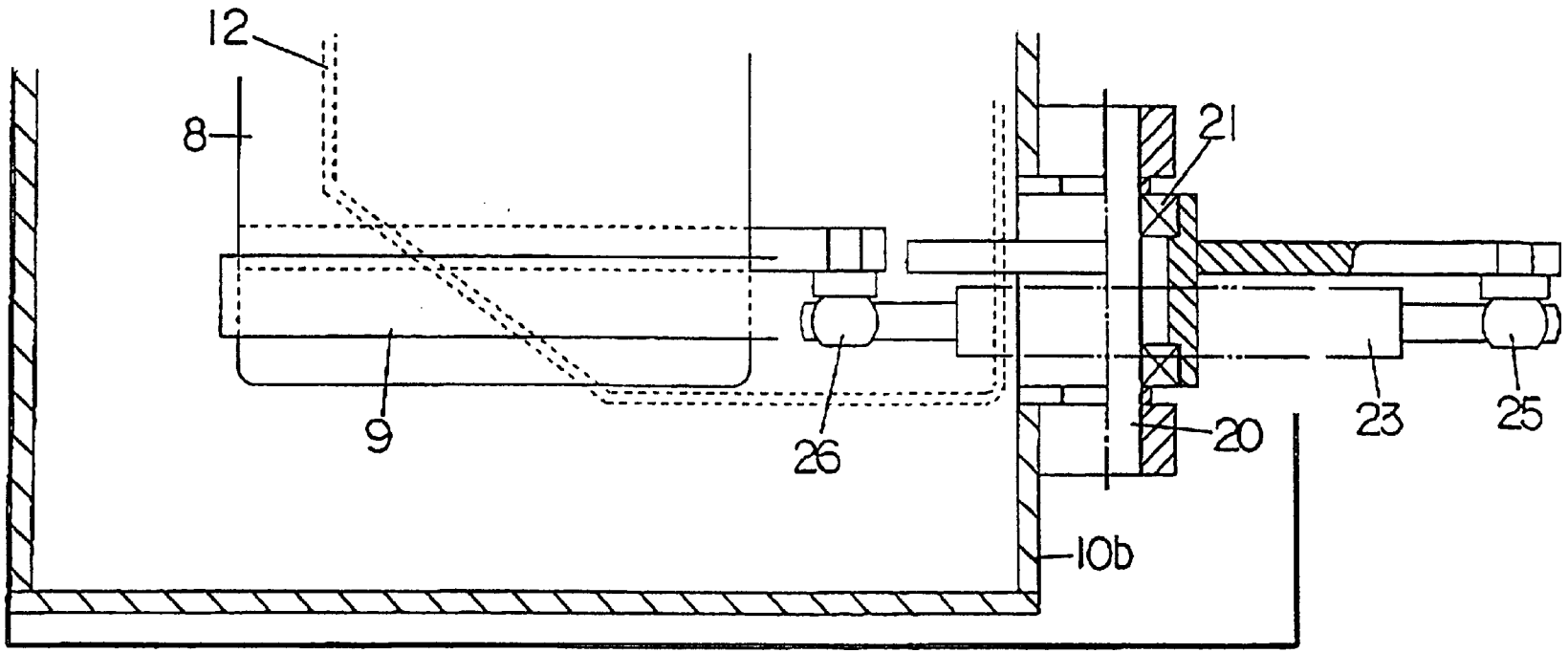
FIG. 4 is a top view, in cross section, of the swing lever part thereof.

As shown in FIGS. 3 and 4, the reciprocating movement means for the slide frame 8 is comprised of a conveying arm horizontally reciprocating rod 19, a substantially L-shaped swing lever 22, and a connecting rod 23. The conveying arm horizontally reciprocating rod 19 is linked to a mechanical cam (not shown), and the substantially L-shaped swing lever 22 is pivotally shaft-supported via a bearing 21 on a supporting shaft 20, which is fastened to the side plate 10*b* of the box 10. The upper end of the conveying arm horizontally reciprocating rod 19 and one end of the swing lever 22, the other end (upper end) of the swing lever 22 and one end of the connecting rod 23, and the other end of the connecting rod 23 and the slide frame 8 are, respectively, connected via universal joints 24 through 26. The conveying arm horizontally reciprocating rod 19 is raised and lowered by the driving force of the mechanical cam; as a result, the swing lever 22 swings, and the slide frame 8 makes a reciprocating movement (as shown by the solid line and imaginary dotted line in FIG. 3). Furthermore, a universal joint is connected to the lower end of the conveying arm horizontally reciprocating rod 19, so that the conveying arm horizontally reciprocating rod 19 can tilt within the plane parallel to the direction of movement of the slide frame 8.

Figure 7:
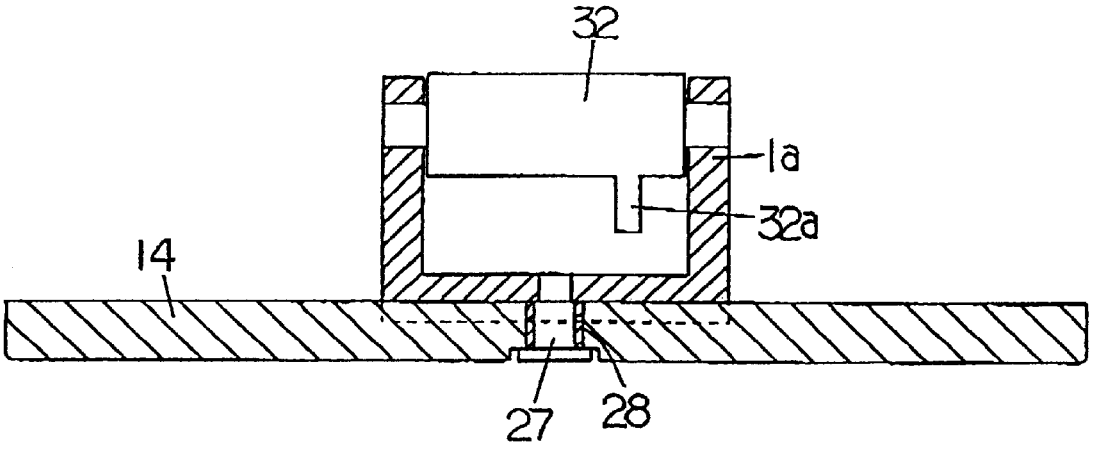
FIG. 7 is a front view, in cross section, of the fixed-side clamping element thereof.

The conveying arm 1 as a whole is a hollow arm, and the area in the vicinity of the tip end is expanded so as to form a recessed-groove-form clamping element attachment 1*a* (see FIG. 7). As shown in FIGS. 1 and 7, a fixed-side clamping element 14 is attached in a floating fashion to the lower portion of the clamping element attachment la via a supporting pin 27 and a bush 28. In other words, the fixed-side clamping element 14 is free to swing slightly in a plane perpendicular to the supporting pin 27, thus being in a floating fashion. In addition, a rubber plate 29 is bonded to the clamping surface of the fixed-side clamping element 14. Furthermore, a supporting shaft 31 is attached to the clamping element attachment 1*a* of the conveying arm 1 inside the upper recessed groove of the clamping element attachment 1*a*. Also, an opening-and-closing arm 32 which has a movable-side clamping element 15 attached to its lower tip end is shaft-supported via the supporting shaft 31 so that the opening-and-closing arm 32 can rotate. The orientations of the clamping surfaces of the respective clamping elements 14 and 15 are set so that the clamped empty bag is in a substantially vertical attitude when the conveying arm 1 reaches a substantially horizontal position.

The floating structure of the clamping elements is employed to insure secure clamping of the empty bags. It is sufficient that the floating structure is applied to one of the pair of clamping elements, but it can be applied to both clamping elements.

The opening-and-closing means that opens and closes the movable-side clamping element 15 is equipped with a mechanical cam (not shown) and a transmission mechanism that transmits the driving force of the mechanical cam to the clamping element. As shown in FIGS. 2 and 3, the transmission mechanism includes a clamping element opening-and-closing rod 33 which is raised and lowered by the mechanical cam (not shown), a first transmission rod 34 which is disposed coaxially in the hollow portion of the hollow rotational shaft 3, and a second transmission rod 35 which is disposed in the hollow portion of the conveying arm 1. The transmission mechanism further includes a transmission mechanism 36 which is between the clamping element opening-and-closing rod 33 and the first transmission rod 34, a transmission mechanism 37 which is between the first transmission rod 34 and the second transmission rod 35, a transmission mechanism 38 which is between the second transmission rod 35 and the clamping element 15, and a compression spring 44 (described later), etc.

As shown in FIG. 2, the first transmission rod 34 is supported by bushes 39 and 40 inside the hollow rotational shaft 3 so that the transmission rod 34 is free to make a reciprocating sliding movement in the axial direction. The front and rear ends of the first transmission rod 34 protrude from the hollow rotational shaft 3, and a pair of roller engaging parts 41, which are of large-diameter flange-form element, are formed on the rear protruding portion of the rod 34.

Figure 5:
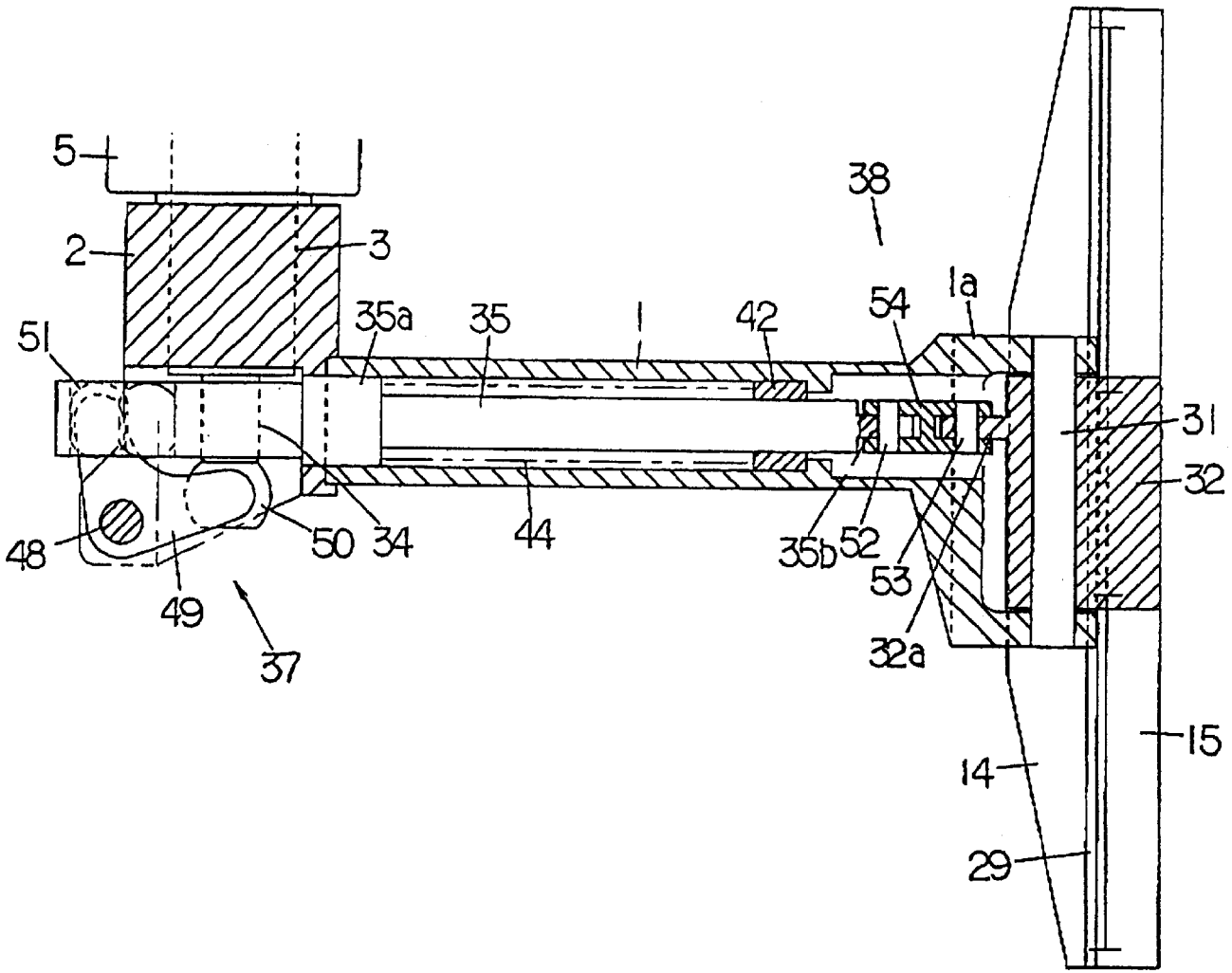
FIG. 5 is a top view, in cross section, of the conveying arm section thereof.
Figure 6:
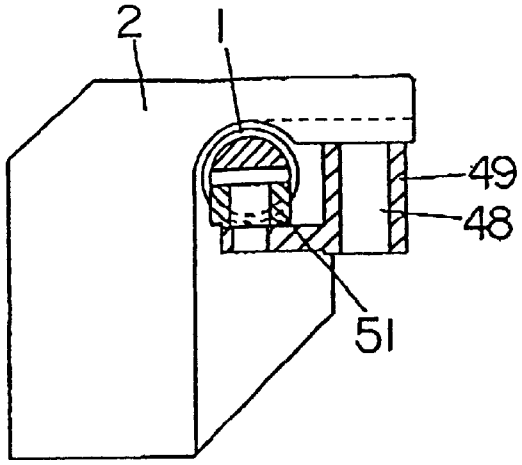
FIG. 6 is a rear view, in cross section, of the opening-and-closing lever part thereof.

As shown in FIGS. 1 and 5, the front end of the second transmission rod 35 is slidably supported by a bush 42, and a large-diameter portion 35*a* on the rear end of this rod 35 is supported by the inside wall surface of the conveying arm 1. The rear portion of the second transmission rod 35 protrudes from the conveying arm 1, and a groove-form roller engaging part 43 is formed in the rear end of the rod 35. Furthermore, a compression spring 44 is disposed around the circumference of the second transmission rod 35 so that the spring 44 is between the bush 42 and the large-diameter portion 35*a*. As a result, the second transmission rod 35 is constantly driven rearward. With this driving force of the spring 44, the movable-side clamping element 15 contacts the fixed-side clamping element 14 with a predetermined pressure.

As seen from FIGS. 2 and 3, the transmission mechanism 36 that connects the clamping element opening-and-closing rod 33 and the first transmission rod 34 is comprised of a supporting shaft 45 which is fastened to the slide frame 8, a swing lever 46 which is pivotally supported on the slide frame 8 via the supporting shaft 45, a pair of engaging rollers 47 and the roller engaging parts 41. The engaging rollers 47 are attached to one end of the swing lever 46 so that these rollers 47 are rotatable and are inserted between the roller engaging parts 41. The upper end of the clamping element opening-and-closing rod 33 and the other end of the swing lever 46 are connected via a universal joint 48. When the clamping element opening-and-closing rod 33 is raised and lowered by the driving force of the mechanical cam, the swing lever 46 swings accordingly about the supporting shaft 45, and the engaging rollers 47 cause the first transmission rod 34 to advance and retract in its axial direction. A universal joint is also connected to the lower end of the clamping element opening-and-closing rod 33. Thus, the clamping element opening-and-closing rod 33 tilts within the plane parallel to the direction of movement of the slide frame 8.

The transmission mechanism 37 that connects the first transmission rod 34 and second transmission rod 35 is, as seen from FIGS. 1, 2, 5 and 6, comprised of a supporting shaft 48, an opening-and-closing lever 49, a pressing roller 50, an engaging roller 51 and the roller engaging part 43. The supporting shaft 48 is fastened to the rotating block 2 in a downwardly-facing attitude, and the opening-and-closing lever 49 is pivotally shaft-supported on the rotating block 2 via the supporting shaft 48. The pressing roller 50 is rotatably attached to one end of the opening-and-closing lever 49 and contacts the front end of the first transmission rod 34. The engaging roller 51 is rotatably attached to the other end of the opening-and-closing lever 49 and is held inside the groove of the roller engaging part 43 on the rear end of the second transmission rod 35. The pressing roller 50 is pressed against the front end of the first transmission rod 34 by the compression spring 44.

When the first transmission rod 34 advances, the opening-and-closing lever 49 is caused to swing about the supporting shaft 48 via the pressing roller 50. Also, the engaging roller 51 causes the second transmission rod 35 to advance in its axial direction against the driving force of the compression spring 44. On the other hand, when the first transmission rod 34 retracts, the second transmission rod 35 is caused to retract accordingly by the action of the compression spring 44. In other words, the second transmission rod 35 advances and retracts in the axial direction when the first transmission rod 34 advances and retracts.

The transmission mechanism 38 of the second transmission rod 35 and clamping element 15 is, as seen from FIGS. 1, 5 and 7, comprised of a connecting link 54 and the opening-and-closing arm 32. The rear end of the connecting link 54 is rotatably connected to a pin 52 which is horizontally fastened to a connecting portion 35*b* on the tip end of the second transmission rod 35. The front end of the connecting link 54 is rotatably connected to a pin 53 that is horizontally fastened to a rear connecting portion 32*a* on the opening-and-closing arm 32. When the second transmission rod 35 advances, the opening-and-closing arm 32 is caused to rotate, in the opening direction of the clamping elements, about the supporting shaft 31 via the pins 52 and 53 and connecting link 54. When the second transmission rod 35 retracts, then the opening-and-closing arm 32 rotates in the closing direction.

In the above bag supplying device, as described above, the conveying arm 1 makes a back-and-forth rotational movement about the axial center of the hollow rotational shaft 3 so that it rotates between the downwardly-oriented clamping position and the substantially horizontal intermediate position. The conveying arm 1 also makes a horizontal reciprocating movement over a predetermined distance D (see FIG. 1). Furthermore, the clamping elements 14 and 15 disposed at the tip end portion of the conveying arm 1 open and close so as to hold and release empty bags.

Examples of desirable operations of the above bag supplying device are as follows:

(1) The conveying arm rotating rod 16 is raised, and the conveying arm 1 rotates into a downwardly-facing attitude and reaches the clamping position. In this case, the conveying arm horizontally reciprocating rod 19 is raised, and the slide frame 8 (along with the conveying arm 1) is positioned in the retracted position. Also, the clamping element opening-and-closing rod 33 is lowered so that the clamping elements 14 and 15 are in an open state. Further, the bag mouth of an empty bag, which is lifted by the vacuum suction holder, etc. from the bag storage receptacle, is positioned between the clamping elements 14 and 15. Here, the clamping element opening-and-closing rod 33 is raised, and the movable-side clamping element 15 is closed by the driving force of the compression spring 44. Thus, the bag mouth of the empty bag W is clamped between the two clamping elements 14 and 15 (i.e., the empty bag is received from the vacuum suction holder, etc.).

(2) The conveying arm rotating rod 16 is lowered, so that the conveying arm 1 rotates into an upward-facing attitude and reaches the substantially horizontal intermediate position. In the conveying process, the empty bag W shifts from a horizontal attitude to a substantially vertical attitude.

(3) The conveying arm horizontally reciprocating rod 19 is lowered, so that the conveying arm 1 advances horizontally over a predetermined distance D, thus bringing the empty bag W to the position of the gripper of the automated packaging machine with the bag maintained "as is" in a substantially vertical attitude. Here, the gripper is closed, and the clamping element opening-and-closing rod 33 is then lowered so that the clamping element 15 opens, thus accomplishing transfer of the bag to the gripper.

(4) The conveying arm horizontally reciprocating rod 19 is raised so that the conveying arm 1 is retracted. Then, the conveying arm rotating rod 16 is raised so that the conveying arm 1 rotates into a downwardly-facing attitude.

Next, another bag supplying device of the present invention will be described with reference to FIGS. 8 and 9.

This bag supplying device differs from the preceding bag supplying device in terms of the means that transmits the driving force of the first transmission rod 61 in the opening-and-closing means that opens and closes the movable-side clamping element 15. In all other respects, the bag supplying device of FIGS. 8 and 9 has the same structure and functions as the bag supplying device described above. In the following description, the same elements are labeled with the same reference numbers.

Figure 8:
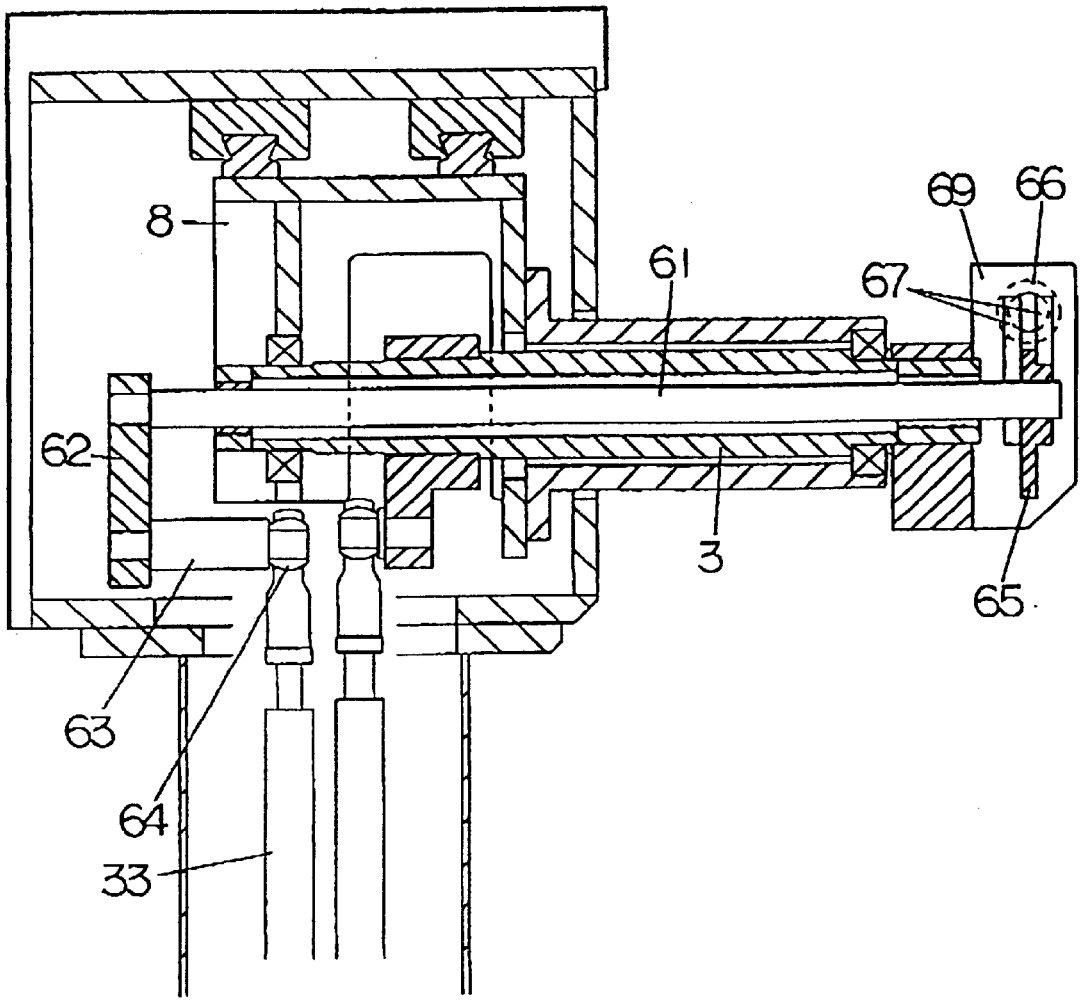
FIG. 8 is a rear view, in cross section, of another bag supplying device according to the present invention.
Figure 9A:
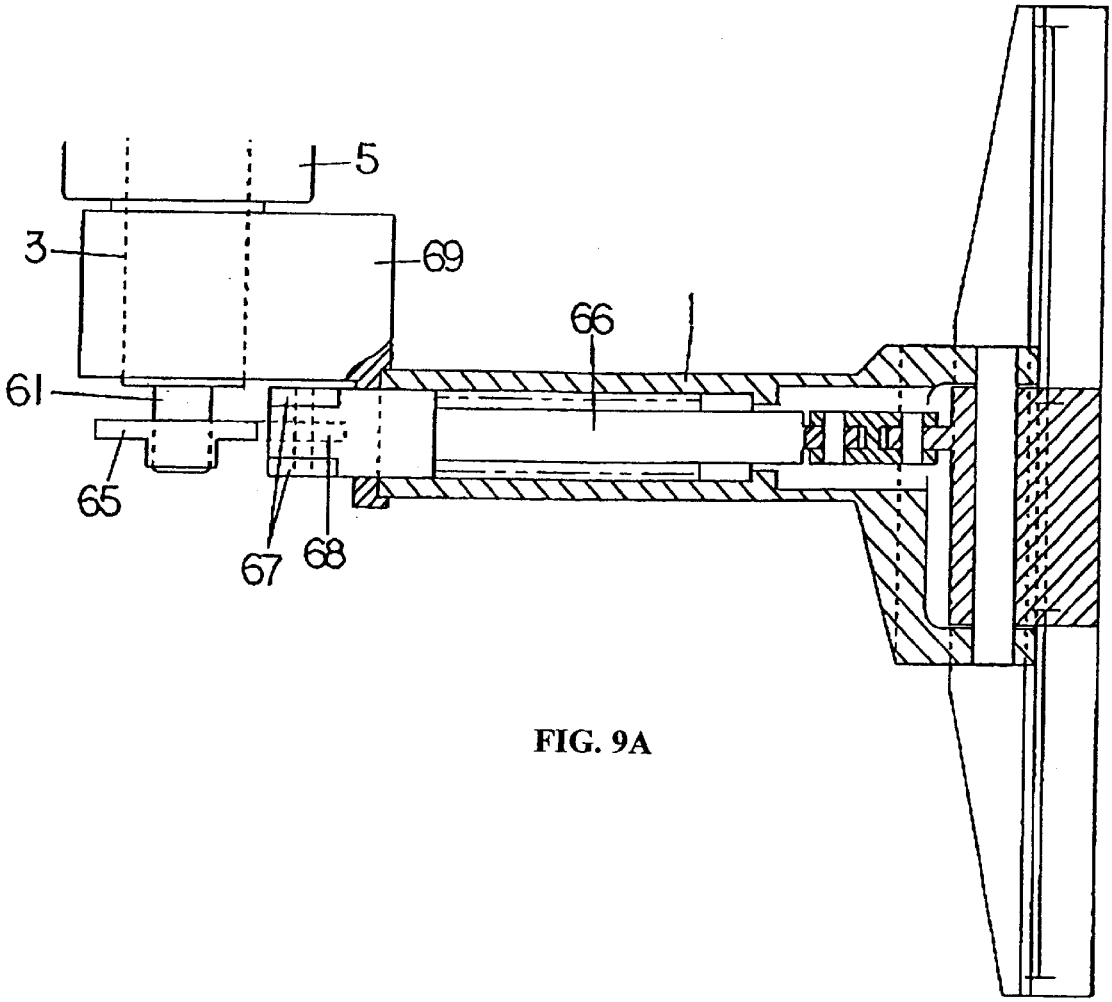
FIG. 9A is a top view, in cross section, of the conveying arm section thereof.
Figure 9B:
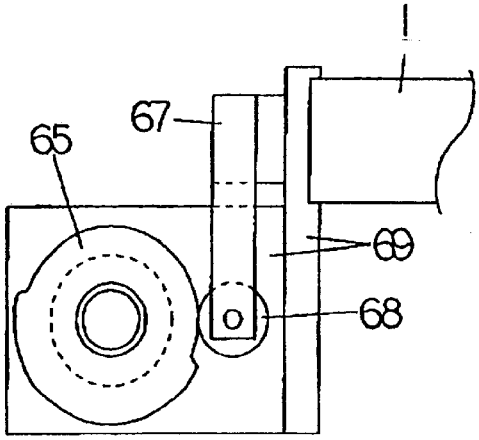
FIG. 9B is a left-side view of the clamping element opening-and-closing cam.

In the structure of FIGS. 8 and 9, one end of a swing lever 62 is fastened to the rear end of the first transmission rod 61, a horizontal connecting rod 63 is fastened to another end of this swing lever 62. The connecting rod 63 and the clamping element opening-and-closing rod 33 are connected via a universal joint 64. When the clamping element opening-and-closing rod 33 is raised and lowered by the driving force of the mechanical cam (not shown in FIGS. 8 and 9), the swing lever 62 swings accordingly. Accordingly, the first transmission rod 61 makes a back-and-forth rotational movement about its axis inside the hollow rotational shaft 3.

Furthermore, a clamping element opening-and-closing cam 65 is fastened to the front end of the first transmission rod 61, and a cam roller 68 is rotatably attached to the rear end of the second transmission rod 66 via an attachment plate 67. The cam roller 68 rotates on the circumferential surface of the clamping element opening-and-closing cam 65.

The reference numeral 69 refers to a rotating block to which the conveying arm 1 is fastened. The rotating block 69 is fastened to the tip end portion of the hollow rotational shaft 3 as in the preceding bag supplying device.

In this bag supplying device of FIGS. 8 and 9, when the clamping element opening-and-closing rod 33 is raised and lowered, the first transmission rod 61 rotates. The driving force is thus transmitted to the second transmission rod 66 via the clamping element opening-and-closing cam 65, cam roller 68 and attachment plate 67, so that the second transmission rod 66 is caused to advance and retract.

Still another bag supplying device of the present invention will be described with reference to FIG. 10.

In this bag supplying device, an empty bag that has been conveyed on a belt conveyor 70, stopped by contacting a stopper and further lifted by a vacuum suction holder, etc. (not shown) is supplied to the holding means of the next process. The bag supplying device is disposed on a stand 71. Empty bags are suction-chucked and conveyed by a vacuum suction holder 73 disposed at the tip end of the conveying arm 72 instead of the clamping elements 14 and 15 that are used in the bag supplying device shown in FIGS. 1 through 7.

Figure 10:
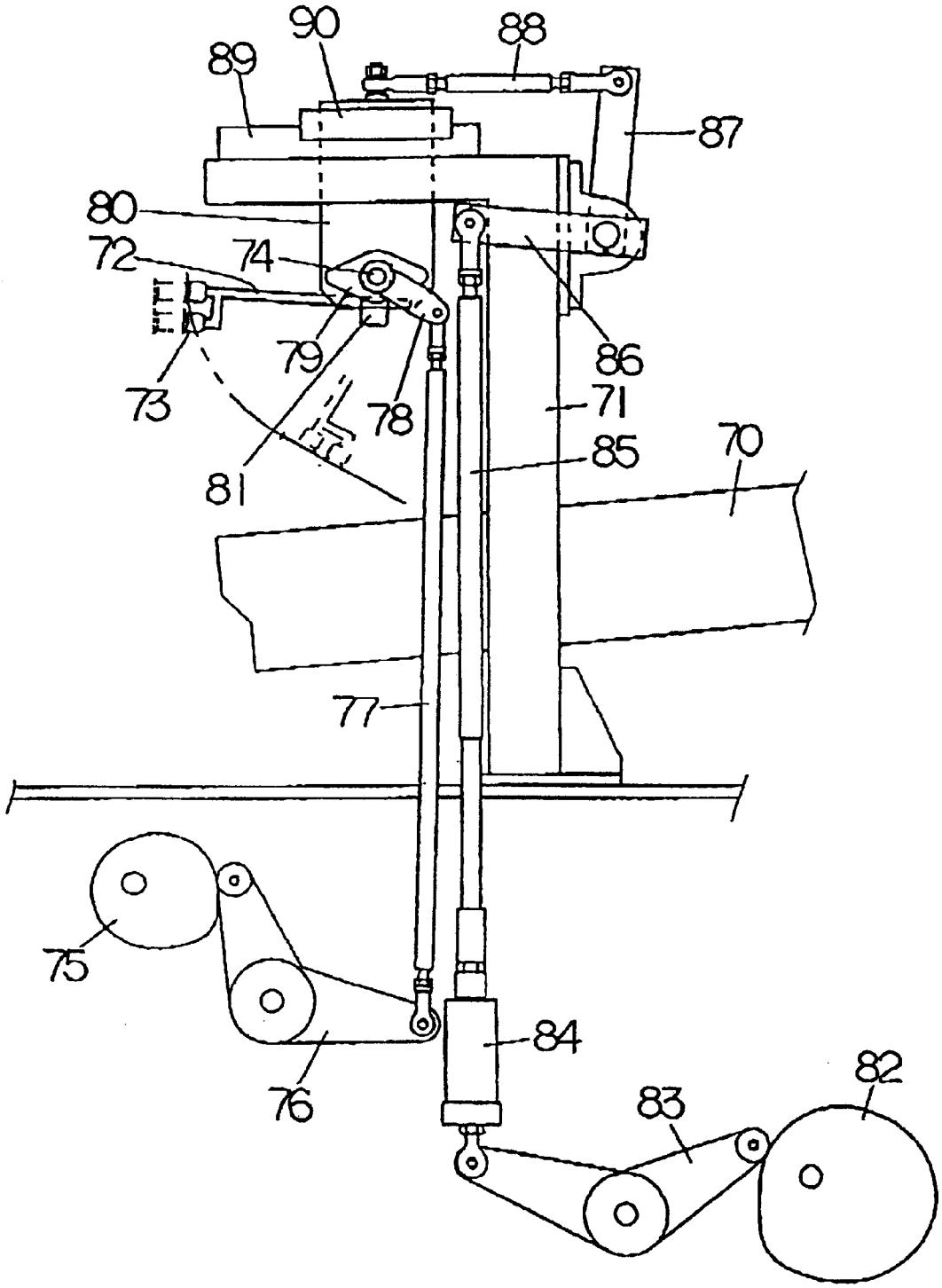
FIG. 10 is a side view of another bag supplying device according to the present invention.

In the bag supplying device of FIG. 10, the conveying arm 72 makes, by a back-and-forth rotation means, a back-and-forth rotational movement about the axial center of a rotational shaft 74 so that the conveying arm 72 rotates between a downwardly-facing suction-chucking position (indicated by the imaginary dotted lines) and a substantially horizontal intermediate position (indicated by the solid lines).

The back-and-forth rotation means is comprised of a mechanical cam 75, a cam lever 76, a conveying arm rotating rod 77 and an intermediate swing lever 78. One end of the intermediate swing lever 78 is fastened to the rotational shaft 74, which is attached to a slide frame 80 via a bearing 79 so that the rotational shaft 74 can rotate. Furthermore, the conveying arm 72 is fastened to the rotational shaft 74 via a swing lever 81. When the mechanical cam 75 rotates, the conveying arm rotating rod 77 is raised and lowered by the driving force of the cam so that the rotational shaft 74 rotates. As a result, the conveying arm 72 makes a back-and-forth rotational movement as described above.

The conveying arm 72 is caused, by a reciprocating movement means, to make a horizontal reciprocating movement accompanying the horizontal reciprocating movement of the slide frame 80. The reciprocating movement means for the conveying arm 72 is comprised of a mechanical cam 82, a cam lever 83, an interference-preventing air cylinder 84, a conveying arm horizontally reciprocating rod 85, an intermediate swing lever 86, a swing lever 87 and a connecting rod 88. The tip end of the connecting rod 88 is attached to a slider 90 that is free to slide on a slide rail 89, and the slide frame 80 is attached to this slide member 90. When the mechanical cam 82 rotates, the conveying arm horizontally reciprocating rod 85 is raised and lowered by the driving force of this cam, and the slide member 90 and slide frame 80 make a reciprocating movement. As a result, the conveying arm 72 reciprocates as described above.

In this bag supplying device of FIG. 10, as in the preceding bag supplying devices, the conveying arm 72 makes a back-and-forth rotational movement about the axial center of the rotational shaft 74 between a downwardly-facing suction-chucking position and a substantially horizontal intermediate position. The conveying arm 72 also makes a horizontal reciprocating movement over a predetermined distance (in FIG. 10, the vacuum suction holder 73 that moves from the intermediate position to the transfer position is indicated by a solid line and an imaginary dotted line). The vacuum suction holder 73 disposed at the tip end portion of the conveying arm 72 suction-chucks the empty bag in the suction-chucking position, and releases this empty bag in the transfer position, so that the bag is transferred to a holding means of the next process.

In the above bag supplying device of FIG. 10, the rod element of the interference-preventing air cylinder 84 is ordinarily retracted. When the rod element of this cylinder 84 is extended, the advancing-and-retracting reference position of the slide frame 80 is retracted from the ordinary position. Thus, even if the slide frame 80 is caused to advance to the maximum extent by the rotation of the mechanical cam 82, the vacuum suction holder 73 on the tip end of the conveying arm 72 does not reach the holding means of the next process. Thus, an interference-preventing means is provided so that the advancing-and-retracting reference position of the slide frame is set to be a retracted position from the ordinary position. There is a reason for providing the interference-preventing means. In some cases, a discrepancy occurs between the timing of the movement of the holding means of the next process and the timing of the operation of the conveying arm 72. If such a discrepancy occurs, the holding means and vacuum suction holder 73 interfere with each other, and they are damaged. The interference-preventing means forcibly prevents this situation.

Such an interference-preventing means that causes the advancing-and-retracting reference position of the slide frame to be retracted from the ordinary position as described above can be installed in the bag supplying devices shown in FIGS. 1 through 9.

As seen from the above, according to the bag supplying device of the present invention, the bag mouths of empty bags are held by the clamping elements, or the bag surfaces are suction-chucked. Then, the bags are rotated and conveyed upward from below over a circular-arc-form path running more or less along the bag surfaces, and the bags are placed in a substantially vertical attitude in the conveying process. Further, the bags are conveyed in this attitude over a short distance horizontally to the position of a holding means such as a gripper, etc. This series of conveying operations are made without any transfer during the conveying. Accordingly, empty bags are delivered to the position of the gripper in more or less a vertical attitude without any transfer errors and without much air resistance during conveyance. Furthermore, when the bags are clamped or held at the mouths, the bag mouths of the empty bags do not open during conveyance. Accordingly, errors in the transfer of the bags to the holding means such as a gripper, etc. are reduced. Thus, the bag supplying device meets the reduction in the thickness of the bags and the increase in the speed of bag supply.

Furthermore, in the present invention, the rotational shaft can be a hollow tube and a transmission rod can be installed concentrically with this rotational shaft, so that this structure is used for the clamping element opening-and-closing means. In this structure, the position of the transmission rod relative to the rotational shaft does not change even if the conveying arm rotates, and the driving force transmission structure is simplified.

What is claimed is:

1. A bag supplying device for an automated packaging machine, said bag supplying device comprising:

a conveying arm having a pair of clamping elements in the vicinity of a tip end thereof, said clamping elements for clamping bag mouths of empty bags, a back-and-forth rotation means that causes said conveying arm to make a back-and-forth rotational movement about an axis of a horizontal rotational shaft, said back-and-forth rotational movement being made together with said rotational shaft so that said conveying arm rotates between a downwardly-oriented clamping position and a substantially horizontal intermediate position, a slide frame that rotatably supports said rotational shaft, a reciprocating movement means that causes said slide frame to make a reciprocating movement in a horizontal direction, thus causing said conveying arm to advance toward and retract from a transfer position, an opening-and-closing means that opens and closes said pair of clamping elements, wherein when said conveying arm is in said clamping position, said clamping elements close and clamp a bag mouth of an empty bag, said empty bag takes a substantially vertical attitude as said conveying arm rotates upward and approaches said intermediate position, and said clamping elements open when said conveying arm advances and reaches said transfer position, thus transferring said empty bag in said substantially vertical attitude to a next holding means.

2. The bag supplying device for an automated packaging machine according to claim 1, wherein:

said opening-and-closing means that opens and closes said clamping elements is equipped with a mechanical cam and a transmission mechanism, said mechanical cam being disposed outside said slide frame, and said transmission mechanism transmitting a driving force from said mechanical cam to said clamping elements, said transmission mechanism is comprised of a first transmission rod and a second transmission rod, said first transmission rod being disposed along said rotational shaft and making a reciprocating movement together with said rotational shaft, and said second transmission rod being disposed along said conveying arm and making a back-and-forth rotational movement together with said conveying arm, and a driving force of said mechanical cam is transmitted to said clamping elements via said first and second transmission rods.

3. The bag supplying device for an automated packaging machine according to claim 2, wherein said rotational shaft has a hollow tubular form, and said first transmission rod is disposed in coaxial with and inside said hollow rotational shaft.

4. A bag supplying device for an automated packaging machine, said bag supplying device comprising:

a conveying arm having a vacuum suction holder in the vicinity of a tip end thereof, said vacuum suction holder for suction-chucking empty bags, a back-and-forth rotation means that causes said conveying arm to make a back-and-forth rotational movement about an axis of a horizontal rotational shaft together with said rotational shaft so that said conveying arm rotates between a downwardly-oriented suction-chucking position and a substantially horizontal intermediate position, and a slide frame that rotatably supports said rotational shaft, a reciprocating movement means that causes said slide frame to make a reciprocating movement in a horizontal direction, thus causing said conveying arm to advance toward and retract from a transfer position, wherein when said conveying arm is in said suction-chucking position, said vacuum suction holder suction-chucks an empty bag, said empty bag takes a substantially vertical attitude as said conveying arm rotates upward and approaches said intermediate position, and said vacuum suction holder stops said suction-chucking when said conveying arm advances and reaches said transfer position, thus transferring said empty bag in said substantially vertical attitude to a next holding means.

* * * * *